US005184914A

United States Patent [19]

Basta

[11] Patent Number: 5,184,914

[45] Date of Patent: Feb. 9, 1993

[54] LIFT FOR WATERCRAFT

[76] Inventor: Samuel T. Basta, 2457 137th Ave. SE., Bellevue, Wash. 98005

[21] Appl. No.: 839,813

[22] Filed: Feb. 21, 1992

[51] Int. Cl.[5] ..... B63C 3/06

[52] U.S. Cl. ..... 405/3; 114/44; 114/48; 254/10 C; 414/678

[58] Field of Search ..... 405/1-3; 254/10 C, 10 R, 10 B; 414/477, 227, 228, 229, 476, 478, 495, 678; 114/44-48

[56] References Cited

U.S. PATENT DOCUMENTS

| | | | |
|---|---|---|---|
| 728,117 | 5/1903 | Kirsch et al. . | |
| 1,106,930 | 8/1914 | Desmond . | |
| 1,503,369 | 7/1924 | Lavoie . | |
| 2,505,832 | 5/1950 | Lange . | |
| 2,598,271 | 5/1952 | Klosterman . | |
| 2,613,915 | 10/1952 | Stone . | |
| 2,840,346 | 6/1958 | Du Moulin | 254/10 C |
| 2,896,583 | 7/1959 | Stixrood . | |
| 2,963,176 | 12/1960 | Smith . | |
| 3,021,965 | 2/1962 | Harvey . | |
| 3,033,626 | 5/1962 | Corley . | |
| 3,062,601 | 11/1962 | Sadler et al. . | |
| 3,319,537 | 5/1967 | Pittman . | |
| 3,753,355 | 8/1973 | Knoch | 405/3 |
| 3,863,890 | 2/1975 | Ruffing | 254/10 C |
| 4,022,027 | 5/1977 | Tetzner | 405/3 |
| 4,027,492 | 6/1977 | Carpenter | 414/678 X |
| 4,087,076 | 5/1978 | Getty . | |
| 4,121,840 | 10/1978 | Berg . | |
| 4,211,151 | 7/1980 | Wallischeck . | |
| 4,286,800 | 9/1981 | Lomas | 414/471 X |
| 4,300,439 | 11/1981 | Degnan et al. . | |
| 4,432,664 | 2/1984 | Baldyga . | |
| 4,641,996 | 2/1987 | Seal . | |
| 4,895,479 | 1/1990 | Michaelsen et al. . | |
| 5,007,121 | 4/1991 | McEathron | 254/10 C X |

*Primary Examiner*—Dennis L. Taylor
*Attorney, Agent, or Firm*—Graybeal Jackson Haley & Johnson

[57] ABSTRACT

Upwardly extending pivoting booms are supported on a rectangular base which is submerged in water. Watercraft supports on mounting arms are connected to the pivoting booms. A double-acting hydraulic cylinder attached between the rectangular base and pivoting booms swings the pivoting booms upwardly until they are braced by boom supports on the rectangular base at an angle over center. This raising of the pivoting booms lifts the mounting arms and watercraft supports to remove a craft from the water and disposes the booms, mounting arms, and craft in a stable, secure over center configuration. Actuation of the double-acting hydraulic cylinder in the opposite direction forces the booms back out of the over center position and lowers the craft into the water.

4 Claims, 2 Drawing Sheets

LIFT FOR WATERCRAFT

BACKGROUND OF THE INVENTION

The present invention pertains to lifts for watercraft such as boats and sea planes.

Known in the art is U.S. Pat. No. 4,895,479, issued to Michaelsen, et al., which discloses a lift for a watercraft having a stationary base frame mounted under water and supporting generally upwardly extending, swingable parallel links. A lift platform supported at the upper end portions of the links, in combination with the base frame and links, forms a parallelogram. A hydraulic cylinder is connected generally diagonally of the parallelogram and has a plunger for swinging the links to translate the lift platform up to remove a watercraft from the water, or down to lower the watercraft back into the water. In its raised position, the lift supports the watercraft at an angle such that the swingable, parallel links are disposed under true vertical at about 70°. In order to lock the swingable parallel links in this position, a dog or pawl engages and restrains reciprocation of the hydraulic cylinder. The dog or pawl locks in regularly spaced through-slots on the hydraulic cylinder plunger. This locking mechanism is at best unreliable and can be hazardous because mechanical failure of the dog or pawl results in unexpected lowering of the watercraft on the lift. Additionally, the requirement of this dog or pawl increases the mechanical complexity and cost of the watercraft lift.

A need thus exists for a watercraft lift which supports a watercraft without requiring locking of the hydraulic cylinder mechanism.

A need exists for the above type of watercraft lift which supports a watercraft by means of the raising of pivoting booms into a stable and secure orientation in which the pivoting booms can be braced to hold the watercraft lift safely in its raised position.

SUMMARY OF THE INVENTION

The present invention is a watercraft lifting apparatus which includes a rectangular base submerged in water and having a front transverse beam, a rear transverse beam, and two longitudinal parallel beams. Pivoting booms connect each of the four corners of the rectangular base to swingable mounting arms so as to form two pairs of pivoting booms that form with the mounting arms collapsing parallelograms on which watercraft supports hold the craft during lifting. A double-acting hydraulic cylinder is pivotally connected to the rear transverse beam, and its piston rod is pivotally connected to the two booms that are joined to the front transverse beam such that energization of the double-acting hydraulic cylinder extends the piston rod and swings both pairs of pivoting booms upwardly. This raising of the pivoting booms lifts the mounting arms and the attached watercraft supports to lift a boat out of the water. Upward movement continues over center in which the pivoting booms pass through vertical orientation until the pair of booms adjacent the rear transverse beam engage canted boom stops mounted on the longitudinal parallel base beams adjacent the rear transverse beams. There the booms are braced in a stable, secure over center raised position. Actuation of the double-acting hydraulic cylinder in the opposite direction retracts the piston rod, pulling the swinging booms back over center and thereafter lowering the booms, mounting arms, supports, and watercraft into the water.

BRIEF DESCRIPTION OF THE DRAWINGS

These and other features of the present invention will be evident when considered in light of the following specification and drawings in which.

DETAILED DESCRIPTION OF THE PREFERRED EMBODIMENT

Figure 1:
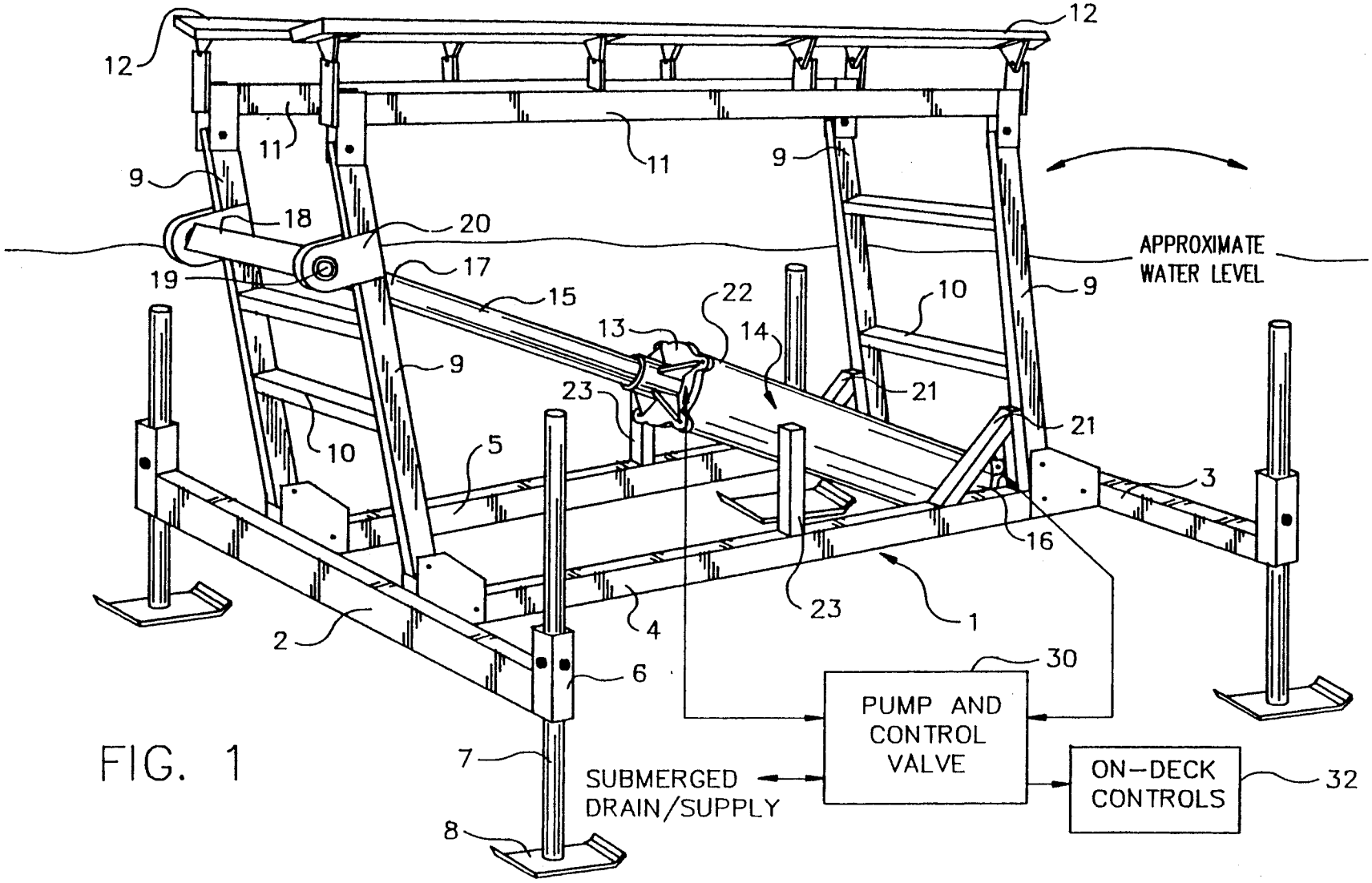
FIG. 1 is an isometric view of the watercraft lift in accordance with the preferred form of the invention.
Figure 2:
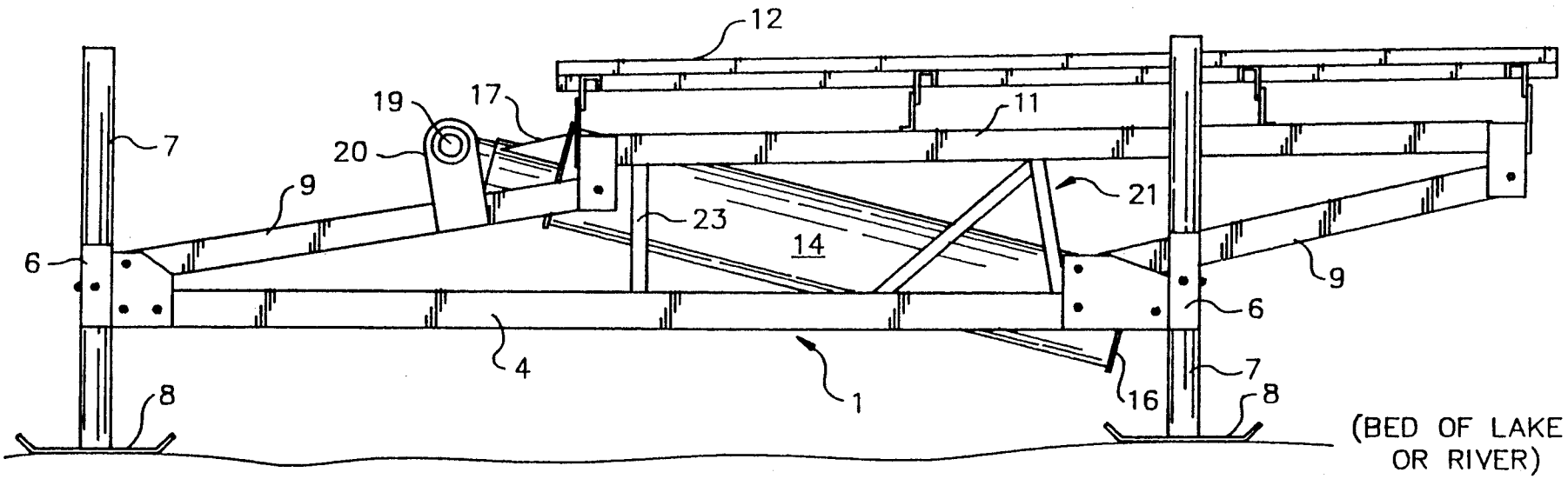
FIG. 2 is a side elevational view of the watercraft lift showing it in the collapsed, lowered position ready to receive a craft at water level.

Referring to FIGS. 1 and 2, the watercraft lift of the present invention has a rectangular base 1 which includes front transverse beam 2 and rear transverse beam 3 which are connected to longitudinal parallel beams 4 and 5. Each of front transverse beam 2 and rear transverse beam 3 have sleeves 6 receiving support posts 7 that are of adjustable height to position the rectangular base 1 at a desired depth submerged in the water. Support posts 7 have shoes 8 which rest on the river or lake bed.

Four pivoting booms 9 are attached to rectangular base 1, one for each of the four corners of rectangular base 1, with the lower boom ends pivotally joined to the base adjacent ends of each of longitudinal parallel beams 4 and 5. Intermediate cross supports 10 provide structural integrity of the front and rear pairs of pivoting booms 9. At the upper ends of pivoting booms 9, two mounting arms 11 are pivotally joined to swing with the booms 9, as a collapsing parallelogram, maintaining parallelism with longitudinal parallel beams 4 and 5. Watercraft supports 12 attached to mounting arms 11 brace the watercraft during lifting.

A double-acting hydraulic cylinder 13 has a piston jacket 14 which extends diagonally of the parallelogram. Lowering and raising of mounting arms 11 and watercraft supports 12 is achieved by extension and retraction of piston rod 15 of double-acting hydraulic cylinder 13. The lower end 16 of the piston jacket 14 is pivotally connected to the rear transverse beam 3. Upper end 17 of piston rod 15 is connected to a collar 18 rotatable on cross rod 19. Cross rod 19 is fitted in flanges 20, which are attached to the front pivoting booms 9 adjacent the upper ends of booms 9.

Each of longitudinal parallel beams 4 and 5 has a boom stop 21 located on its end adjacent rear transverse beam 3. Boom stops 21 engage flat sides of the rectangular section booms 9 adjacent their lower pivoted ends to brace pivoting booms 9 and mounting arms 11 in the raised over center position. Preferably boom stops 21 are canted upward and to the front at an angle of about, for example, 10° over center from vertical. Boom stops 21 form with beams 4 and 5 a substantially triangular shape and have boom engaging and bracing faces angled or canted as described above. Also located on longitudinal parallel beams 4 and 5 are vertical posts 23 which engage and support mounting arms 11 when the boat lift is in the retracted position.

To lift a craft from the water from the retracted position shown in FIG. 2, the piston rod of the double-acting hydraulic cylinder 13 is extended by introduction of water under pressure into the lower end 16 of the piston jacket 14 from a pump and control valve 30 operating under command of on-deck controls 32. A piston in piston jack 14 extends piston rod 15, forcing collar 18, cross rod 19 and hence front booms 9 to swing upwardly and forwardly from their lowered positions to their raised positions. The rear booms 9 and the attached mounting arms 11 follow as the parallelogram is deployed. Thus, a craft is lifted out of the water on watercraft supports 12 that project from arms 11. Full extension of the boat lift is achieved when pivoting booms 9 swing over center (i.e., to about 10° over center), and the two rear booms 9 that are adjacent rear transverse beam 3 engage canted stops 21 bracing and holding the assembly at this angle.

To retract the boat lift, the piston rod 15 of the double acting hydraulic cylinder 13 is retracted by introduction of water under pressure via pump and control valve 30 into the upper end 22 of piston jacket 14. The piston to which piston rod 15 is attached thus retracts piston rod 15 so that the upper end 17 thereof pulls the pivoting booms 9 from their raised positions back over center, whereafter the weight of the booms 9, arms 11, and the watercraft lower back down to the retracted position. In this manner, a craft is lowered in the water on watercraft supports 12 as the lift collapses into its retractive position.

While particular embodiments of the present invention have been described in some detail herein above, changes and modifications may be made in the illustrated embodiments without departing from the spirit of the invention.

I claim:

1. A lift for watercraft comprising:

a substantially rectangular base having front and rear transverse beams and longitudinal parallel beams secured to said front and rear transverse beams;

pivoting booms attached to said base adjacent the points of connection of said front and rear transverse beams and said longitudinal parallel beams;

watercraft support means pivotally connected to said pivoting booms;

boom stop means secured to said longitudinal parallel beams adjacent said rear transverse beam; and actuator means connected to said rear transverse beam and to said pivoting booms adjacent said front transverse beam, said actuator means operable for forcing said pivoting booms from a lowered position to an over center raised position relative to said base to raise said watercraft support means, said pivoting booms being braced in the raised position over center by said boom stop means, and said actuating means operable to retracting said pivoting booms from the raised, braced position back over center to the lowered position to lower said watercraft support means.

2. The lift of claim 1 wherein said boom stop means are canted to brace said boom supports in the raised position at a predetermined angle over center.

3. The lift of claim 1 wherein said boom stop means comprises a triangular-shaped brace on each of said longitudinal parallel beams and have a boom engaging face angled at about 10° over center.

4. A lift for watercraft comprising:

a substantially rectangular base having front and rear transverse beams and longitudinal parallel beams secured to said front and rear transverse beams;

pivoting booms attached to said base adjacent the points of connection of said front and rear transverse beams and said longitudinal parallel beams;

watercraft support arm means pivotally connected to said pivoting booms so that the pivoting booms and support arm means swing as a unit between raised and lowered positions;

triangular-shaped boom support stops secured to said longitudinal parallel beams adjacent said rear transverse beam, each of said triangular-shaped boom support stops having a canted face angled past vertical in the direction away from the swinging motion of the pivoting booms and are adapted to brace said pivoting booms; and cylinder actuator means connected to said rear transverse beam and to said pivoting booms adjacent said front transverse beam, said cylinder actuator means having a piston and a piston rod whereby energization of said cylinder actuator means extends said piston rod to swing said pivoting booms from a lowered position to a raised position relative to said base to raise said watercraft support arm means, said pivoting booms being braced in the raised position at about 10° over center by said triangular-shaped boom support stops, and energization of said cylinder actuator means retracts said piston rod to swing said pivoting booms from the raised, braced position to back over center toward the lowered position to lower said watercraft support means.

* * * * *